United States Patent [19]

Raider

[11] 4,034,659

[45] July 12, 1977

[54] AIR DIFFUSION UNIT AND CONTROL MECHANISM THEREFOR

[76] Inventor: George K. Raider, 1S-132 Summit Ave., No. 301-B, Oakbrook Terrace, Ill. 60181

[21] Appl. No.: 636,409

[22] Filed: Dec. 1, 1975

[51] Int. Cl.[2] ..... F24F 13/06

[52] U.S. Cl. ..... 98/40 D; 98/36; 55/DIG. 29; 55/270; 55/418

[58] Field of Search ..... 98/40 D, 36, 41 R, 32, 98/40 DL, 40 B; 55/270, DIG. 29, 418

[56] References Cited

U.S. PATENT DOCUMENTS

| | | | |
|---|---|---|---|
| 2,845,855 | 8/1958 | Burns | 98/40 DL |
| 2,863,373 | 12/1958 | Steiner | 55/DIG. 29 |
| 2,962,582 | 11/1960 | Croft | 98/40 DL |
| 3,099,200 | 7/1963 | Harrison | 98/40 D |
| 3,252,400 | 5/1966 | Madl, Jr. | 98/40 DL |
| 3,320,404 | 5/1967 | Ronx | 98/40 DL |
| 3,570,385 | 3/1971 | Heisterkamp | 98/32 |
| 3,949,594 | 4/1976 | Treaftis et al. | 55/270 |

*Primary Examiner*—William F. O'Dea
*Assistant Examiner*—Henry C. Yuen
*Attorney, Agent, or Firm*—Hill, Gross, Simpson, Van Santen, Steadman, Chiara & Simpson

[57] ABSTRACT

Plural pressure-displacement type air diffusion modules have separate diffusion means between a control plenum and a space to be conditioned. A single control valve between a source of pressurized air and the control plenum regulates the volume of air admitted into the plenum, whereby laminar flow of air is uniformly produced by pressure displacement through each of the modules. The control valve is either a gate-type valve or a valve head and seat arrangement.

14 Claims, 9 Drawing Figures

AIR DIFFUSION UNIT AND CONTROL MECHANISM THEREFOR

BACKGROUND OF THE INVENTION

1. Field of Invention

This invention relates generally to air diffusion devices for use in environmentally controlled work spaces where conditioned air is introduced uniformly from diffusers located in the ceiling of the work space above a work area. Because of low inlet velocity, the air maintains a downward laminar flow to outlets at the base of the workspace, thereby air turbulence within the space. By minimizing turbulence, circulation of pollutants, such as bacteria or dust, which may have settled in the lower portion of the space, is minimized insuring that the quality of the ambient air in the work area has not been reduced by the circulation of pollutants.

2. Description of Prior Art

The use of pressure-displacement type diffusion devices to distribute conditioned air is exemplified by U.S. Pat. No. 2,304,628 where air is introduced at low velocities throughout the length of a railroad passenger car. As exemplified in U.S. Pat. No. 2,585,666, each diffusion device incorporates structure allowing easy access to an adjustable valve to control the amount of air passing through the individual device. Low velocity diffusion was also adapted for use within a "clean room" to achieve laminar air flow as exemplified by U.S. Pat. No. 3,367,259. The structure of a laminar flow air diffusion device for use within a clean room is further exemplified by U.S. Pat. No. 3,570,385, wherein a light fixture and filter are combined in a diffusion unit.

Prior module designs have failed to provide structure allowing for a simplified and quick balancing of the installation.

Balancing multiple units arranged in a ceiling was difficult and time consuming from a standpoint of access to individual valve controls and specially designed bulky measuring devices for sensing air flow velocity.

Heretofore, the process of balancing air output was most difficult because air velocity was measured at the outlet of each module, which in most all cases was a perforated plate. Because of the low velocity of the air at this point, a standard anemometer could not be used directly. Instead, balancing was attempted by use of funnel devices having a pre-selected one-square foot inlet area and tapering to a narrowed end where there was sufficient air velocity to activate an anemometer and give a reading. Numerous adjustments had to be made to the module to achieve an equal velocity of air output for each square foot of perforations.

SUMMARY OF THE INVENTION

In accordance with this invention, the structure of each diffusion module has been standardized and has been designed to allow quick and easy air flow adjustment. Measurements of the amount of air passing through each module is greatly simplified.

A balanced distribution of air from all of the modules in a work space is achieved for the diffuser module disclosed by this invention by controlling the admission of air into an upper control plenum ahead of a lower distribution plenum within the module. Air from a pressurized source passes through the inlet and valve to the upper control plenum having an area equal to the module size. This upper chamber has two symmetrically located elongated openings equal in area. These two openings allow air to flow into two hinged air diffusion units having a perforated outer surface. The air flows from the diffusion unit into the lower distribution plenum having as its bottom side a perforated diffusion plate which is contiguous with the ceiling of the work space.

During the balancing operation, all diffusion plates and diffusion units are opened to allow complete exposure of the elongated opening from the upper control plenum. Because of the relative small area of this opening with respect to the total surface area of the diffusion plate, there is sufficient air velocity through the opening to be measured by a standard anemometer. This opening has an effect of an orifice.

When the modules are all the same size, it is a simple matter to adjust the air volume control valve so that the average of the readings from the anemometer at each orifice opening within a module approximately equals the other average readings.

If the modules vary in size, it is necessary to apply a correction factor to the reading if the outputs are to be balanced. A module with a greater outlet surface area must be supplied with more air than that of smaller module. Therefore, the velocity of air through the orifice opening of a larger unit must be relatively greater than the velocity of air in a smaller unit if the orifice opening is the same size.

When the air introduced to a work space must be particularly free of airborne particulate, it is necessary to equip each module with a high efficiency particulate arrestor or more commonly known as a Hepa filter. This filter is placed between the inlet valve and the upper control plenum. The filters are not installed until after the air flow through the modules have been balanced. Since the pressure drop across clean filters is approximately equal, the system remains in balance after the filters are installed. During replacement of the filter the control valve is closed to prevent unfiltered air entering the work space or requiring that the system be shut down. Prior module designs have failed to recognize and provide means to insure that the work space remains at the desired level of cleanliness during filter changes.

DETAILED DESCRIPTION OF THE INVENTION

To insure laminar flow throughout a work space, it is essential that each diffusion module within an installation discharge the same quantity of air. Since the effective open area of each unit is approximately equal, the amount of air passing through a module is directly proportioned to velocity of the air. Therefore, by equalizing the velocity of the air through each module, the volume of air through each module is likewise equalized. If the modules were discharging air at varying velocities, turbulence could result. Turbulence, in turn, could cause the circulation of pollutants before their discharge through outlets located in the base of the work space.

Figure 1:
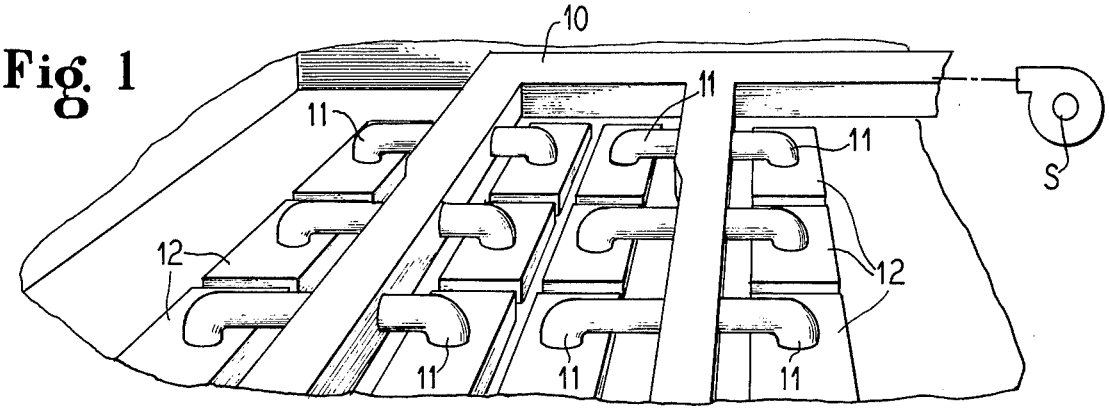
FIG. 1 is a view from above the ceiling of a typical installation where individual modules are being supplied air from a system of supply ducts.
Figure 2:
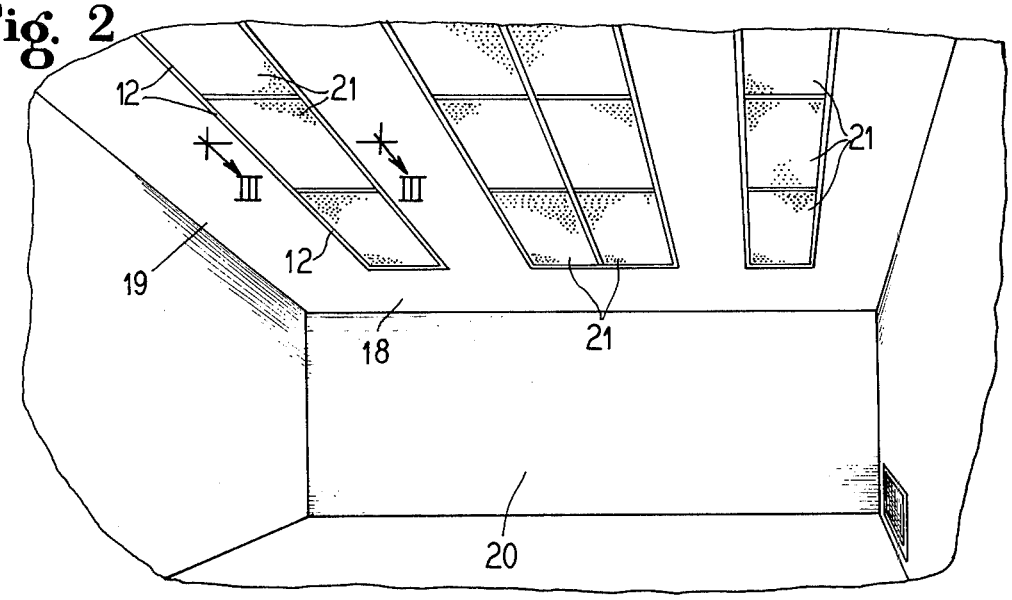
FIG. 2 is a perspective view of the installation as viewed from within a work space.
Figure 7:
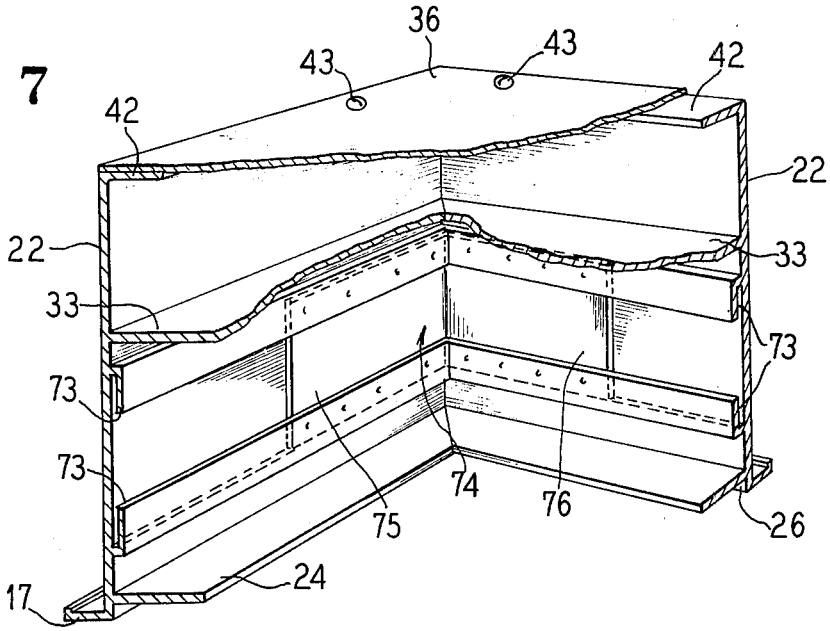
FIG. 7 is a detail of a typical inside corner of the module constructed from an extruded frame member.

Referring to the drawing, a system embodying the principles of this invention is shown in FIG. 1 and FIG. 2 installed in a ceiling of a space to receive conditioned air. Conditioning air includes the control of temperature, moisture content and airborne particulate concentration. A source of conditioned air is shown schematically at S and discharges the supply of air into a system of ducts 10. As shown in FIG. 1, a plurality of individual air diffuser modules are arranged in a distribution array spaced both laterally and longitudinally over a ceiling area.

A connecting duct 11 can be conveniently made of a flexible, tubular material and interconnected to the supply duct 10 with an individual air diffusion module 12. The end of each duct 11 connects with a collar 13 located at the top of the module 12 to form a sealed joint 14 between the collar 13 and duct 11.

The modules 12 can be supported by a system of T-shaped frames 15 which are in turn carried by a wire 16 which fastens to superstructure above the module 12. The modules 12 are installed such that their bottom surface 17 aligns horizontally with ceiling panels 18 to make up a ceiling 19 for a work space 20. As seen in FIG. 2, the distribution of modules 12 with ceiling panels 18 gives a clean, attractive appearance.

Figure 3:
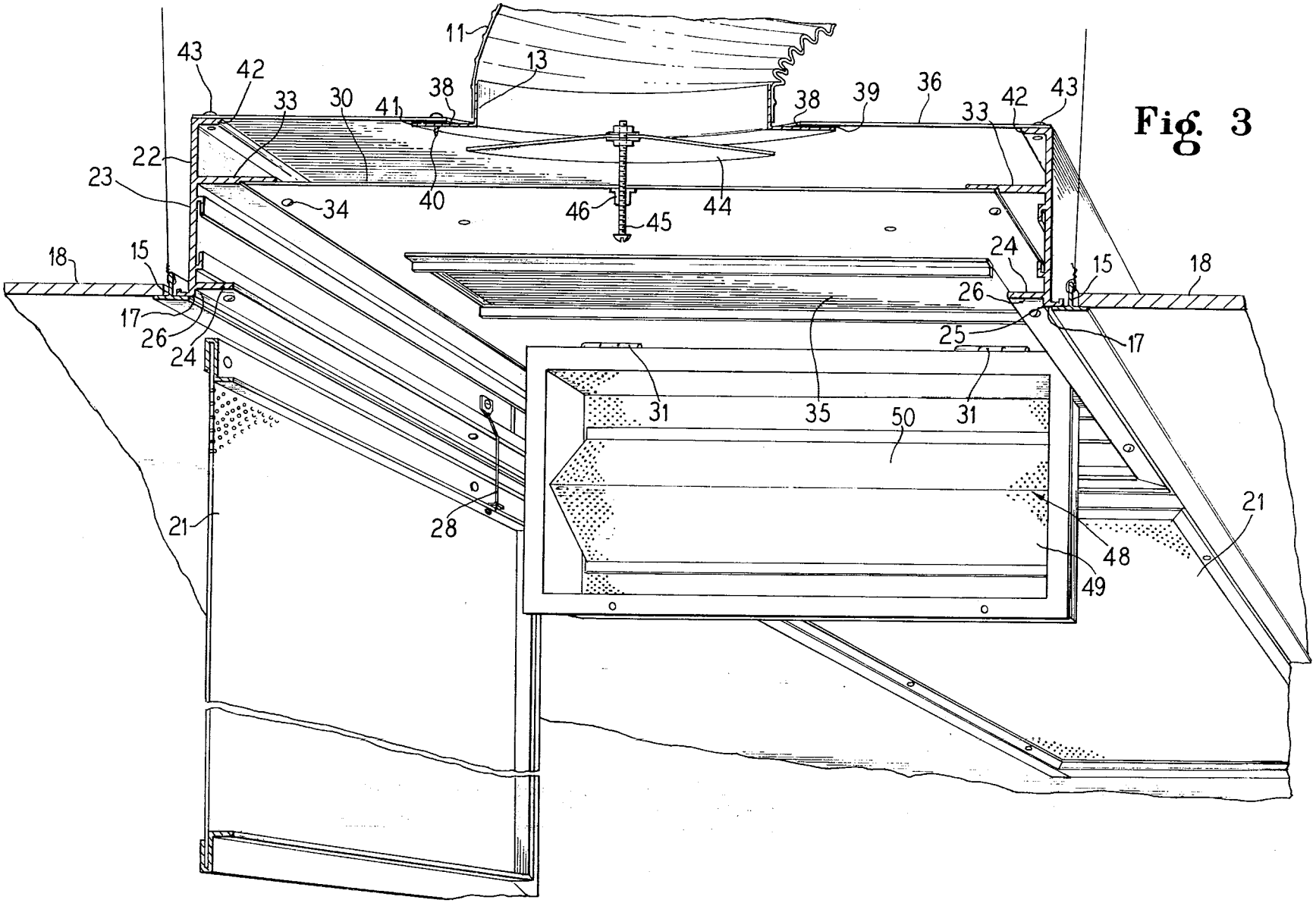
FIG. 3 is a cross-sectional view of a module as viewed from within the work space when the installation is to be balanced.
Figures 4, 5, 6:
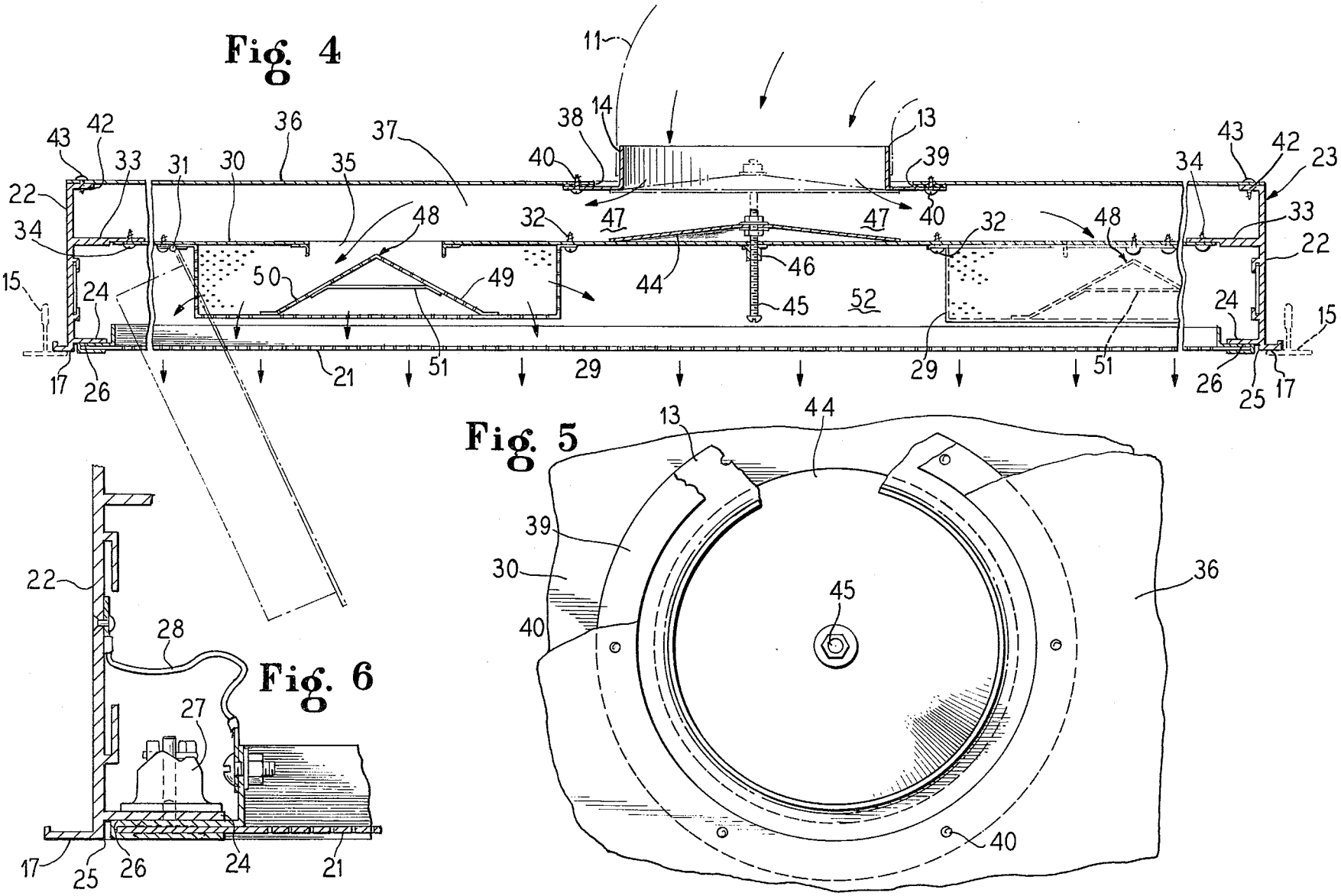
FIG. 4 is a cross-sectional view through the side of a module while in use.
FIG. 5 is a top view of the inlet area of the module.
FIG. 6 is a detailed cross-sectional view of a quick release fastener and support cable for the air diffusion plate.

Once the modules 12 and ceiling panels 18 have been installed and connected to the air supply through the system of ducts 10 and connecting ducts 11, the installation is ready to be balanced. As shown by FIG. 3, each module 10 has a perforated air diffusion plate 21 which has been selected to have an approximate 16 percent open area. The plate is secured to a frame member 22. The module 10 has a frame body 23 made up of four frame members 22. Each frame member 22 has an inwardly protruding support flange 24 just above a bottom edge 25 of frame member 22. The flange 24 and the inside of the frame member 22 provide an offset 26 into which air diffusion plate 21 is recessed. The plate 21 is held in position by four quick release fasteners 27, one each located in the corners of the plate. With the fasteners 27 released, the plate 21 is free to swing to a vertical position as shown in FIG. 3. The plate 21 is connected to the frame body 23 by two safety cables 28 which allow the plate 21 to drop 6 inches below the frame body 23. With the plate 21 so dropped, two air diffusion units 29 are exposed. Each unit 29 is rectangular box shaped and is secured to an intermediate horizontal plane 30 by a hinge 31 and screws 32 located along the respective elongated sides of the unit 29. By unfastening the screws 32, the air diffusion unit 29 is also free to swing to a vertical position as shown in FIG. 3. The intermediate plate 30 is carried by intermediate flanges 33 which protrude inwardly from the frame members 22 and secured to such by sheet metal screws 34.

With the air diffusion unit 29 swung to a vertical position, an orifice opening 35 in the intermediate horizontal plate 30 is exposed. Each module has two such orifice openings equal in area.

The module 12 has a top plate 36 which with the frame members 22 and the intermediate plate 30 defines an upper control plenum 37. In the middle of the top plate 36 is a circular hole 38 into which is disposed the collar 13, which with a gasket 39 and screws 40 form a sealed joint 41.

The top plate 36 is carried by top flanges 42 which protrude inwardly from the frame members 22 and is secured to such by screws 43.

Beneath the collar 13 is a conically shaped air volume control disc 44 which can be raised or lowered by the rotation of an attached adjustment screw 45. The screw 45 is threadedly engaged with a stud 46 welded to the bottom side of the intermediate plate 30. With the disc 44 in its lowermost position, an inlet opening 47 is maximized. The inlet opening 47 is reduced as the disc 44 is raised by the rotation of the adjustment screw 45.

During the balancing procedure, all the air diffusion plates 21, and the air diffusion units 29 are opened, and the air volume control discs 44 are lowered to maximize the openings 47. The velocity of input air is measured at each orifice opening 35 for each module; an average of the velocities then is determined. As was noted before, if the outlet surface area of the modules vary significantly, it is necessary to apply a correction factor to the average velocity. A larger module must be supplied more air (at a higher velocity) than a module with a lesser outlet surface area.

Using the average velocity through each module, an overall average velocity then is determined for all modules. If each average module velocity does not exceed ±5 percent of the overall average velocity of all the modules, the system is considered in balance. In a balanced system, therefore, no average module velocity should vary by more than 10 percent from any other average module velocity. If any average air velocity for a module exceeds these limits, its air volume control disc 44 can be raised to reduce air input. When the installation is in balance, the air diffusion units 29 and the air diffusion plates 21 are returned to a normal position and refastened.

During normal use, air enters the module 12 from connecting air duct 11 through the collar 13 and is outwardly deflected by the disc 44 into the upper control plenum 37. From the upper control plenum 37 the air passes through the orifice openings 35 into the air diffusion units 29. Each unit has a perforated deflection angle plate 48 having two outwardly and downwardly legs 49/50 joining at an obtuse angle. The apex of the angle aligns with the longitudinal center line of the orifice opening 35. On the underside of the deflection angle plate 48 is a solid horizontal plate 51 welded to the inside of the legs 49 and 50 and prevents the air entering through the orifice 35 from flowing directly downward. From the air diffusion unit 29 the air is disbursed into a lower supply plenum 52 which is defined by the intermediate plate 30, the air diffusion plate 21 and the frame members 22. From the lower supply plenum 51 the air flows through air diffusion plate 21 into work space 20.

Figure 9:
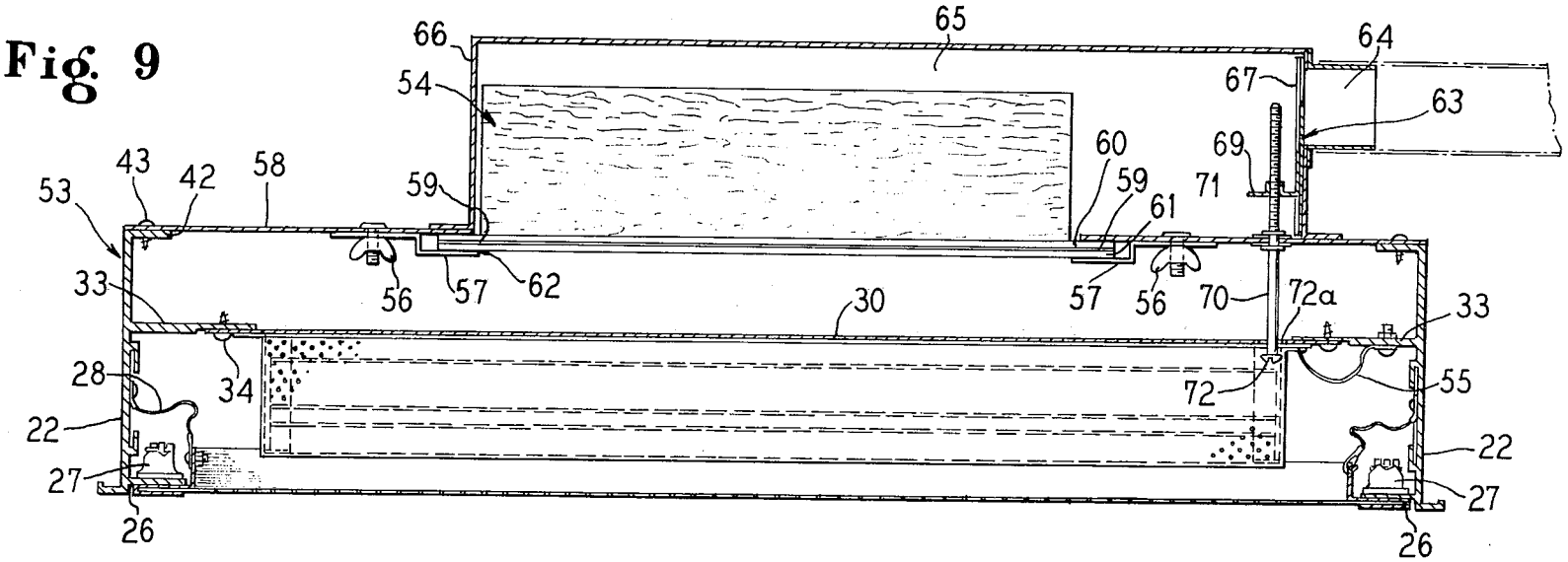
FIG. 9 is a cross-sectional view of the module shown in FIG. 8.
Figure 8:
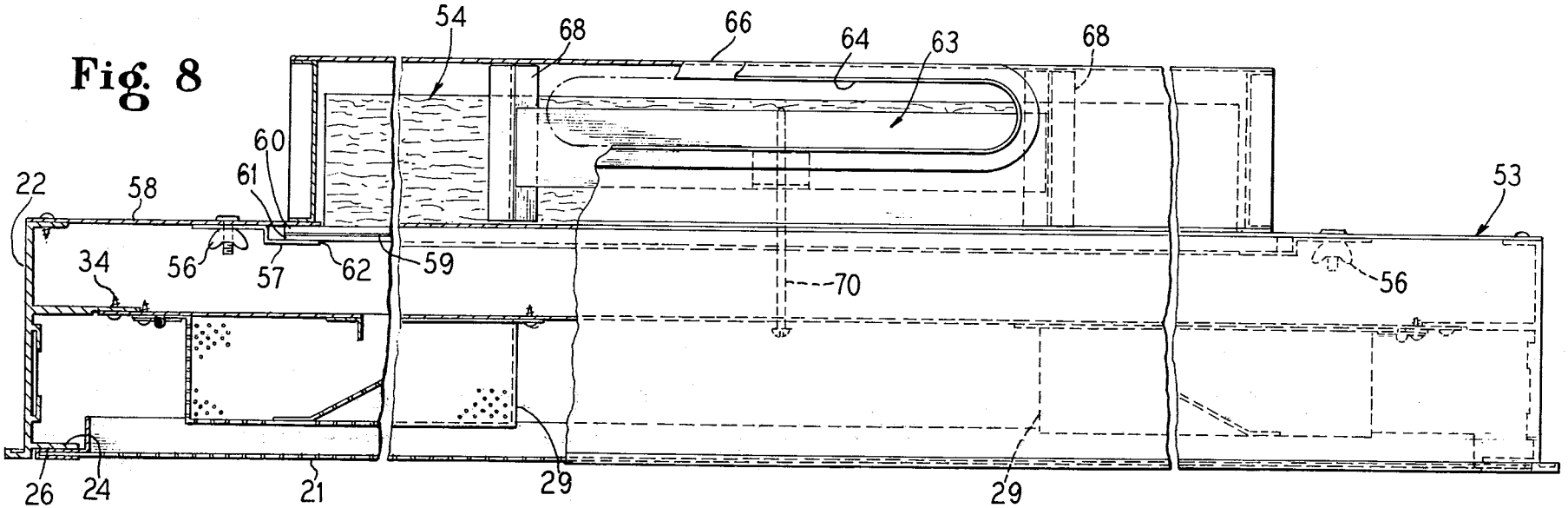
FIG. 8 is a side view of a module prepared to use a Hepa filter.

In FIG. 8 and FIG. 9 is a module 53 prepared for use with a Hepa filter 54. The structure of the module 53 provides easy access to and removal of the Hepa filter 54. The intermediate plate 30 can be removed by unscrewing sheet metal screws 34. With screws removed, the plate 30 is free to drop to a vertical position where it is supported by cables 55 which are fastened to the intermediate flange 33.

The Hepa filter 54 can be removed by unscrewing a series of intermittently spaced wing nuts 56, which secures a Z-shaped bracket 57 to a top plate 58. The bracket 57 in turn holds a protruding flange 59 around the base of the Hepa filter 54 between an upper and lower neoprene gasket 60/61 forming a seal 62 preventing air from by-passing the filter 54. As noted before, the system is balanced with the filters 54 removed.

When it becomes necessary to replace the filter 54, the air through the module 53 must be closed off by shutting an air control valve 63. By providing the valve 63 ahead of the filter 54, replacement can be completed without compromising the environmental quality in the work space. Such a compromise could occur if the total system had to shut down since a positive air pressure is maintained in the work space to prevent the accidental entrance of non-filtered air. Likewise, a compromise would occur if there was a discharge from the module 53 without the Hepa filter 54 in place. With the air control valve 63 closed, air is prevented from entering an oval-shaped air inlet 64 into a filter chamber 65. This chamber 65 is defined by the top plate 58 and a filter cover box 66 which encloses the upstream side of the Hepa filter 54.

The air control valve 63 consists of a vertically mounted gate 67 slidably secured by two Z-shaped brackets 68 carried by the cover box 66, one each adjacent to the elongated ends of the inlet 64. The gate 67 has a horizontal right angle flange 69 extending inwardly which is threadly engaged with a vertically mounted adjacent screw 70. This screw 70 is mounted in a bearing-like grommet 71 carried in the top plate 58. The screw 70 has a slotted head 72 which extends through a hole 72*a* in the intermediate plate 30 allowing accessibility and easy adjustment of valve 63 when the air diffusion plate 21 is released.

It is necessary to count the number of revolutions required to turn the adjacent screw 70 to close valve 63. By rotating screw 70 the same number of turns, but in the opposite direction, the valve 63 is returned to its original location avoiding unbalancing the system after filter 54 has been replaced and the module 53 is returned to service. Since the amount of air passing through each module 53 is approximately the same, each filter becomes contaminated at the similar rate. Therefore, all of the filters should be changed at the same time. The lower portion of the module 53 is identical to that of module 12 having a perforated bottom plate 21, and two air diffusion units 29 located below orifice openings 35.

To facilitate the assembly of the frame body 23, the frame members 22 can be made as an extrusion. By so forming, the top flange 42, the intermediate flange 33, the bottom edge 25 and the support flange 24 become an integral part of the frame member 22. The extrusion is cut to a desired length and each end mitered at a 45 degree angle. The extruded frame member 22 has an inner longitudinal channel 73. The module body 23 is assembled by mating the mitered ends of the frame members 22 after a right angle corner plate 74 has had its legs 75 and 76 inserted into the respective channel 73 in each frame member 22. The legs 75/76 of corner plate 74 then are tacked to the respective channels 73.

While various modifications may be suggested by those versed in the art, it should be appreciated that I wish to embody within the scope of the patent warranted herein, all such modifications as reasonably and properly come within the scope of my contribution to the art.

I claim as my invention:

1. A method of balancing air volume output from laminar air flow diffusion modules having approximately equal outlet surface areas installed in a work space where the ambient air surrounding a performance of a task must be conditioned to a certain standard which includes the following steps:

a. connecting inlets of said modules to an air supply means, said means supplying air to said modules,
b. placing respective air diffusion plates carried in a bottom portion of each module in an open position,
c. placing respective air diffusion units carried by each module adjacent to and upstream from said plate in an open position,
d. setting respective air volume control valves carried by each module adjacent to and downstream from said inlet in a maximum open position,
e. measuring the velocity of the supplied air with an anemometer as said air passes through an orifice opening in an intermediate plate, said plate being carried by each module and located between said air diffusion unit and said air volume control valve,
f. selectively adjusting the air volume control valve such that the measured velocity of the air passing through each orifice opening equals all other measured velocities within 10 percent, and
g. placing each air diffusion unit and each air diffusion plate to a normal position, wherein said modules deliver to said work space air having a uniform laminar downward flow so as to maintain the ambient air surrounding the performance of the task within said standards of conditioning.

2. A method of balancing air volume output from laminar air flow diffusion modules having varying outlet surface areas installed in a work space where the ambient air surrounding a performance of a task must be conditioned to a certain standard which includes the following steps:

a. connecting inlets of said modules to an air supply means, said means supplying air to said modules,
b. placing respective air diffusion plates carried in a bottom portion of each module in an open position,
c. placing respective air diffusion units carried by each module adjacent to and upstream from said plate in an open position,
d. setting respective air volume control valves carried by each module adjacent to and downstream from said inlet in a maximum open position,
e. measuring the velocity of the air with an anemometer as said air passes through an orifice opening in an intermediate plate, said plate being carried by each module and located between said control valve and said air diffusion unit, adjusting said measurement to compensate for the module outlet surface areas,
f. selectively adjusting the air control valve such that the adjusted measured velocity of the air passing through each orifice opening equals all other adjusted velocities within 10 percent, and g. placing each air diffusion unit and each air diffusion plate to a normal position, wherein said modules deliver to said work space air having a uniform downward laminar air flow so as to maintain the ambient air surrounding the performances of the task with said standards of conditioning.

3. An air diffusion system for supplying a laminar air flow input into a work space where the ambient air surrounding a performance of a task must be conditioned to a certain standard comprising:

a. an air supply means for supplying air, said means supplying air conditioned to said standard, b. an air distribution means for distributing said supplied air, said distribution means connected to said supply means.

c. air diffusion module means carried by a ceiling portion of said work space to provide said work space with a uniform laminar downward air flow, said modules connected to said air distribution means, and said air supply means supplying air to said modules through said distribution means, and each module including, an upper control plenum connecting with said air distributing means through a module inlet, a lower supply plenum defined in part by an intermediate plate separating said upper control plenum from said lower supply plenum, said intermediate plate having at least two selectively positioned and sized openings to provide for a uniform passage of said air from said upper plenum to said openings and a readily removable perforated bottom plate to provide an outlet for said air from said module to said work space, diffusion means hingedly attached to said intermediate plate to cover said openings and positioned within said lower plenum to provide a uniform passage of said air through said openings in said intermediate plate throughout said lower plenum, said means selectively relocatable to allow an unrestricted access to said openings in said intermediate plate.

balancing means for selectively controlling the amount of air passing through each module, said means carried, one each, by a respective module upstream from said intermediate plate, wherein said balancing means is selectively adjusted to equalize the velocity of air passing through each opening in said intermediate plate so that the amount of air input by each module into the work space is approximately equal.

4. An air diffusion system as defined by claim 3 and further characterized by said module comprising:

a box-shaped body comprising four frame members having end portions joining at a right angle to form enclosing vertical sides and a horizontal top plate carried by a top portion of said frame members, an inlet defined by a circular opening in said top plate and connected to said air distribution means, a control plenum defined by said top plate as a top, said frame members as sides and a horizontal intermediate plate as a bottom, said orifice means defined by two rectangular openings in said intermediate plate, and said balancing means comprising a conical-shaped disc being axially aligned and located below said inlet and above said intermediate plate and a screw means having a top portion attached to the bottom side of said disc and a lower portion threadedly engaged and extending below said intermediate plate, a rotation of said screw means raising and lowering said disc, wherein said supplied air enters said body through said inlet, passes into said upper control plenum and through said openings in the intermediate plate.

5. An air diffusion system as defined by claim 3 and further characterized by:

said supplied air conditioned less than said standard, and a filtering means for removing additional particulate from said supplied air, said filtering means carried by said module between said balancing means and said orifice means, wherein the air supply is further condition by said filter to be within said standard.

6. An air diffusion system for supplying a laminar air flow input into a work space where the ambient air surrounding a performance of a task must be conditioned to a certain standard comprising:

a. an air supply means for supplying air, said means supplying air conditioned to said standard, b. an air distribution means for distributing said supplied air, said distribution means connected to said supply means, c. air diffusion modules carried by a ceiling portion of said work space, said modules connected to said air distribution means, and said air supply means supplying air to said modules through said distribution means, d. an orifice means carried by each module for measuring a velocity of said supplied air through said orifice, and e. a balancing means for selectively controlling the amount of air passing through each module, said means carried, one each, by a respective module upstream from said orifice means, wherein said balancing means is selectively adjusted to equalize the velocity of air passing through each orifice means so that the amount of air input by each module into the work space is approximately equal, said supplied air conditioned less than said standard, and a filtering means for removing additional particulate from said supplied air, said filtering means carried by said module between said balancing means and said orifice means, wherein the air supply is further conditioned by said filter to be within said standard.

each said module comprising:

a box-shaped body comprising four frame members having end portions joining at a right angle to form enclosing vertical sides and a horizontal top plate carried by a top portion of said frame members, said top plate having an opening therein prepared to receive said filtering means, a filter chamber carried by said body in an uppermost position thereof, said chamber defind by said top plate as a bottom of said chamber and a filter cover box having a horizontal top and four connecting vertical sides, said box aligned with said opening in said top plate, an inlet defined by an oval-shaped opening in one of said vertical sides to said filter chamber and connected to said air distribution means, said filter means comprising a Hepa filter having a box-shaped body and an outwardly projecting bottom flange, said filter body extending upwardly into said filter chamber through said opening in said top plate and said flange and said top plate joining to form a seal, a control plenum defined by said top plate as a top, said frame members as sides and a horizontal intermediate plate as a bottom, said orifice means defined by two rectangular openings in said intermediate plate, and said balancing means comprising an L-shaped gate having a vertical leg slidably secured to said vertical side of said filter cover box and positioned to cover said inlet when said gate is raised to an uppermost position and a screw means having an upper portion threadably connected to a horizontal leg of said gate, a center portion rotationally engaged with said top plate and a bottom portion extending downwardly through a hole in said intermediate plate, a rotation of said screw means raising and lowering said plate, wherein said supplied air enters said body through said inlet into said filter chamber, passing through said filter into said control lenum, and then through said openings in said intermediate plate.

7. An air diffusion module for use in a laminar air flow diffusion system comprising:

a. a module body b. an inlet opening into said body prepared for connection to an air distributing system, c. a balancing means for controlling an amount of air entering said body, said means carried by said body and located adjacent to and downstream from said inlet, d. an upper control plenum in said body being downstream from said balancing means, e. an intermediate plate forming a bottom for said upper control plenum and having two orifice openings therein, said openings providing outlets from said control plenum, f. two air diffusion units hingably carried by said intermediate plate, said unit having a box-like perforated body to allow a flow of air through said body, said respective unit positioned adjacent to and downstream from said respective orifice opening, g. a lower distribution plenum in said body being downstream from said diffusion unit, and h. a removable air diffusion bottom plate carried by said body and forming a bottom for said lower distribution plenum, said plate being perforated to allow a flow of air from said lower chamber into a work space, wherein said module is used to distribute air having a laminar flow.

8. An air diffusion unit according to claim 7 and further characterized by:

said body being box-shaped comprising four frame members having end portions joining at a right angle to form enclosing vertical sides and a horizontal top plate carried by a top portion of said frame members, said plate forming a top for said upper control plenum, said inlet defined by a circular opening in said top plate, said balancing means comprising a conical shaped disc being axially aligned and located below said inlet and above said intermediate plate and a screw means having a top portion attached to a bottom side of said disc and a lower portion threadedly engaged with and extending below said intermediate plate, a rotation of said screw means raising and lowering said disc, and said orifice openings being rectangular and symmetrically located in said intermediate plate, wherein said disc is raised to regulate an air supply through said orifice opening.

9. An air diffusion module defined by claim 7 and further characterized by:

a filter means for removing additional particulate from said air supply, said filter carried by said body between said balancing means and said upper control plenum, wherein said filter means is used to further remove airborne particulate.

10. An air diffusion unit according to claim 9 and further characterized by:

said body being box-shaped comprising four frame members having end portions joining at a right angle to form enclosing vertical sides and a horizontal top plate carried by a top portion of said frame members, said plate forming a top for said control plenum and having a rectangular opening therein prepared to receive said filtering means, a filter chamber carried by said body in an uppermost portion thereof, said chamber defined by said top plate as a bottom of said chamber and a filter cover box having a horizontal top and four connecting vertical sides, said box aligned with said opening in said top plate, said inlet defined by an oval-shaped opening in one of said vertical sides of said filter cover box, said filtering means comprising a Hepa filter having a box-shaped body and an outwardly projecting bottom flange, said filter body extending upwardly into said chamber through said opening in said top plate, and said flange and said top plate joining to form a seal, said orifice openings being rectangular and symmetrically located in said intermediate plate, and said balancing means comprising an L-shaped gate having a vertical leg slidably secured to said vertical side of said filter cover box and positioned to cover said inlet when said plate is raised to an uppermost position and a screw means having an upper portion threadedly connected to a horizontal leg of said gate, a center portion rotationally engaged with said top plate and a bottom portion extending downwardly through a hole in said intermediate plate, a rotation of said screw means raising and lowering said plate.

11. An air diffusion module as defined by claim 7 and further characterized by said body comprising:

an elongated frame member forming a vertical side, said member having as an integral part thereof, inwardly projecting support flanges for supporting, an inner elongated channel, and mitered end portions, and a corner angle plate having a right and left leg portion for securing respective frame members, wherein said body is fabricated by joining four frame members to form an enlosed area having right angle corners made by mating respective mitered end portions of said frame members and securing said corners by inserting the legs of said angle plate into the respective inner channel of said respective frame member forming said corner.

12. A pressure-displacement type ventilating apparatus comprising, a source of pressurized conditioned air, duct means leading from said source to a point of utilization, an outlet module connected to said duct means and more specifically comprising, a module body, a first distribution plenum carried by said body and having a suitable inlet connecting with said duct, a second distribution plenum carried by said body and separated from said first distribution plenum by an intermediate plate, an outlet diffusor forming a readily removable bottom of said second distribution plenum to allow a distribution of said air to a space below, said diffusor providing selective access to said intermediate plate, intermediate diffusion means including a selectively sized orifice opening in said intermediate plate to provide for a movement of said air between said first and second distribution plenums and hingeable diffusing means attached to a bottom of said intermediate plate and positioned to selectively cover said orifice opening and causing a diffusion of said air passing through said orifice and into said second distribution plenum, and a control valve carried by said module body and controlling the admission of said air into said first distribution plenum, wherein a volume of said air through said outlet diffusor may be selectively regulated by said control valve as a function of a velocity of said air passing through said orifice opening when said diffusing means is removed and said orifice opening is uncovered.

13. An air diffusion module for use in a laminar air flow diffusion system comprising, a. a modular body, b. an air flow inlet for connection to a source of said air flow and carried by said body in a top portion thereof, c. first distribution chamber carried by said body adjacent to said inlet to receive said flow of air from said inlet, said chamber including at least two outlet means each having a selected fixed size to discharge an approximate equal volume of air downwardly, d. diffusion means to cause a dispersion of air flow passing through said separate outlet means of said first distribution chamber, said diffusion means removably attached to a bottom of said first chamber and positioned to diffuse air downwardly, e. a second distribution chamber carried by said body adjacent to said diffusion means to receive said air flow from said diffusion means and including a selectively removable perforated bottom plate to provide a diffusion outlet for said second chamber when said plate is in a first condition and an unrestricted access to said diffusion means and to said first chamber outlet in said second condition, f. valve adjustment means carried by said body to regulate said air flow through said air flow inlet to said first chamber, said means being readily accessible when said bottom plate of said second distribution chamber is in said second condition so that the module may be balanced in a system by controlling the flow of air through said inlet.

14. An air diffusion module as defined by claim 13 and characterized as including, means for filtering said air carried by said body between said air flow inlet and said first distribution chamber.

* * * * *